United States Patent [19]

Bruenner et al.

[11] 4,410,376

[45] Oct. 18, 1983

[54] BONDING AGENT FOR POLYURETHANES

[75] Inventors: Rolf S. Bruenner, Orangevale; Adolf E. Oberth, Fair Oaks, both of Calif.

[73] Assignee: The United States of America as represented by the Secretary of the Air Force, Washington, D.C.

[21] Appl. No.: 393,170

[22] Filed: Jun. 28, 1982

[51] Int. Cl.[3] ..... C06B 45/10

[52] U.S. Cl. ..... 149/19.4; 149/38; 149/42; 149/44; 149/76; 149/88; 149/92

[58] Field of Search ..... 149/19.4, 38, 42, 44, 149/76, 88, 92

[56] References Cited

U.S. PATENT DOCUMENTS

| | | | |
|---|---|---|---|
| 4,000,023 | 12/1976 | Oberth et al. | 149/19.4 |
| 4,091,729 | 5/1978 | Bell et al. | 102/38 |
| 4,165,247 | 8/1979 | Brew et al. | 149/19.4 |
| 4,214,928 | 7/1980 | Consaga | 149/19.4 |

*Primary Examiner*—Stephen J. Lechert, Jr.

*Attorney, Agent, or Firm*—Donald J. Singer; Charles E. Bricker

[57] ABSTRACT

An improved bonding agent for a solid rocket propellant, having the general formula $$[X_2N(CH_2CH_2NX)_nCH_2CH_2NX_2](HO_3SC_6H_4CH_3)_z$$

wherein n is an integer having a value of 1 to 11, X is —H or —$CH_2CH_2CN$; wherein the amount of —$CH_2CH_2CN$, expressed as y, is in the approximate range of 0.15 (n+4) to 0.45 (n+4), the amount of $HO_3SC_6H_4CH_3$, expressed as z, is in the approximate range of 0.01 (n+4) to 0.25 (n+4), and the ratio y:z is in the range of 1.5:1 to 3:1.

3 Claims, No Drawings

BONDING AGENT FOR POLYURETHANES

RIGHTS OF THE GOVERNMENT

The invention described herein may be manufactured and used by or for the Government of the United States for all governmental purposes without the payment of any royalty.

BACKGROUND OF THE INVENTION

This invention relates to solid propellants, and in particular to bonding agents for polyurethane propellant binders.

Heretofore, it has been proposed to use bonding agents to form a hard and tough binder layer around the filler in a solid propellant, the filler normally being the oxidizing agent. This envelope is linked to the binder matrix by primary chemical bonds. In order to accomplish this result, a bonding agent must fulfill the requirements of being adsorbed to the oxidizer surface and of forming a tough and coherent layer. One known bonding agent is 2,3-dihydroxypropyl-bis(2-cyanoethyl)amine. With this bonding agent, the adsorption is accomplished essentially by its in solubility in the binder phase. In propellant binders where this bonding agent is too soluble, such as nitroplasticized systems, it becomes inefficient. Similarly, the formation of a tough 2,3-dihydroxypropyl-bis(2-cyanoethyl)amine layer depends on the high reactivity of the hydroxyl groups toward the isocyanate, which must be higher than the reactivity of the other alcoholic constituents in the binder matrix. Therefore, in binder systems having very reactive prepolymers, 2,3-dihydroxypropyl-bis(2-dyanoethyl)amine becomes inefficient.

In U.S. Pat. No. 4,000.023, there are disclosed bonding agents which do not depend on hydroxyl groups and the ensuing urethane reaction to yield the envelope necessary for bonding. Also, being strong bases these bonding agents are chemisorbed as well as adsorbed to the surface of the oxidizing agent. These bonding agents have the general formula $$X_2N(CH_2CH_2NX)_nCH_2CH_2NX_2$$

wherein n is an integer having a value of 1 to 12, and X is hydrogen, cyanoethyl, dihydroxypropyl or mixtures thereof with the proviso that at least one X is hydrogen.

In particular, the said patent focused upon tetraethylene pentamine and its cyanoethyl and dihydroxypropyl derivatives.

We have now found that these cyanoethyl-modified bonding agents can be further modified to provide more improved bonding agents.

Accordingly, it is an object of the present invention to provide an improved group of bonding agents for solid rocket propellants having polyurethane binders.

It is another object of this invention to provide a method for making improved bonding agents.

Other objects and advantages of the invention will be apparent from the description which follows.

SUMMARY OF THE INVENTION

In accordance with the present invention, there is provided an improved bonding agent which may be defined as the adduct of acrylonitrile and a polyalkylene polyamine which is partially neutralized with p-toluene solfonic acid. This composition has the general formula $$[X_2N(CH_2CH_2NX)_nCH_2CH_2NX_2](HO_3SC_6H_4CH_3)_z$$

wherein n is an integer having a value of 1 to 11, X is —H or —$CH_2CH_2CN$, wherein the amount of —$CH_2CH_2CN$, expressed as y is in the approximate range of 0.15 (n+4) to 0.45 (n+4), the amount of $HO_3SC_6H_4CH_3$, expressed as z, is in the approximate range of 0.01 (n+4) to 0.25 (n+4), and the ratio y:z is in the range of 1.5:1 to 3:1.

Also provided in accordance with the present invention are a method for making this composition and a solid propellant composition comprising the improved bonding agent of this invention.

DETAILED DESCRIPTION OF THE INVENTION

The improved bonding agent of this invention is made by a two-step process which first comprises reacting a polyalkylene polyamine with acrylonitrile, and thereafter reacting the resulting adduct with p-toluene sulfonic acid.

In the aforesaid U.S. Pat. No. 4,000,023, there is disclosed the inefficiency of ethylene diamine as a propellant bonding agent and the increasing efficiency with increasing number of ethylene imine units in the molecule, thus establishing a first boundary for the value of n in the above formula. It is also disclosed that dodecaethylene tridecamine is so viscous that adequate dispersion in a propellant batch becomes a problem, thus establishing the second boundary for the value of n in the above formula.

The polyalkylene polyamine:acrylonitrile adduct is prepared by combining the two ingredients with stirring and with cooling. The reaction is exothermic, so cooling must be employed to avoid decomposition of the adduct. Examples of suitable polyalkylene polyamines include diethylene triamine, triethylene tetramine, tetraethylene pentamine, hexaethylene haptamine, octaethylene nonamine, decaethylene undecamine, dodecaethylene tridecamine and the like. A presently preferred polyalkylene polyamine is tetraethylene pentamine. In this case the value of n in the aforementioned formula is 3. Accordingly, the amount of acrylonitrile to be combined with the tetraethylene pentamine can range from 0.15 (3+4) to 0.45 (3+4), i.e., from 1.05 to 3.15 moles of acrylonitrile per mole of the polyamine. The addition of the acrylonitrile to the tetraethylene pentamine is carried out at a temperature of about 80° C.

The polyalkylene polyamine:acrylonitrile adduct is then partially neutralized with p-toluene sulfonic acid. This reaction is also exothermic and must be carried out with stirring and with cooling so as to avoid decomposition of the resulting composition. This reaction is carried out under anhydrous conditions, and preferably using an essentially anhydrous solvent which is inert to the reactants. After the reaction is complete, the solvent is removed and the resulting composition is ready for use as a bonding agent in a solid rocket propellant composition.

In the case of the aforementioned tetraethylene pentamine:acrylonitrile adduct, the value of n is 3. Accordingly, the amount of p-toluenesulfonic acid to be combined with the adduct can range from 0.01 (3+4) to 0.25 (3+4), i.e., from 0.07 to 1.75 moles of p-toluenesulfonic acid per mole of the adduct.

The bonding agent of the present invention is useful in solid propellants having polymeric binders derived from polyether-diols, triols, and the like, and polybutadiene-diols, -triols, and the like, with isocyanates as curatives (polyurethanes). The propellants may contain fuels such as cyclotetramethyltetranitramine (HMX), cyclotrimethylenetrinitramine (RDX), trimethylolethane trinitrate (TMETN), aluminum, oxidizing agents, plasticizers, stabilizers, and the like.

In general, the bonding agent of this invention is used in propellant formulations in a bond improving amount, generally at concentrations of about 0.375 to about 2.25 percent (w/w) of the binder, while the amount of binder ranges from about 10 to about 25 percent (w/w) of the total composition. For ease in handling, the bonding agent of this invention may be diluted with a suitable diluent, one which is preferably inert to the various ingredients in a propellant composition and which will not later exude out of the cured propellant. One suitable diluent is tetraethylene glycol dimethylether. The bonding agent of this invention may be diluted up to about 50 percent (w/w) with this diluent.

The following examples illustrate the invention.

EXAMPLE I

Preparation of Bonding Agent

Cyanoethylated tetraethylene pentamine was prepared by adding acrylonitrile to tetraethylene pentamine in a mole ratio of 2:1, as described in our U.S. Pat. No. 4,000,023.

From a mixture of 184 pounds of toluene and 230 pounds (548.45 moles) of p-toluenesulfonic acid monohydrate, the water was removed by azeotropic distillation. To the remaining solution, 424 pounds (651 moles) of the tetraethylene pentamine:acrylonitrile adduct were added gradually, with stirring, to maintain the temperature of reaction at or below 90° C. After the addition was complete, the toluene was distilled off at 60° C. and 61.5 mm Hg, under sparging with nitrogen.

EXAMPLE II

A series of propellants was prepared. These propellants had the mechanical properties shown in the table, below. One of these propellants, designated in the table by an asterisk (*) was prepared according to the following recipe.

| Ingredients | Weight Percent |
|---|---|
| Aluminum | 18,000 |
| Cyclomethylenetetranitramine | 48,000 |
| Ammonium Perchlorate | 16,000 |
| Bis-2,2,2-(2,2,2-fluorodinitro-ethyl)formal | 10,000 |
| Polyethylene glycol, mw ≅ 4000 | 6,796 |
| Trimethylolpropane | 0,146 |
| Invention Bonding Agent** | 0,135 |

-continued

| Ingredients | Weight Percent |
|---|---|
| Hexamethylenediisocyanate | 0,617 |
| Diphenylamine | 0,300 |
| Ferric acetylacetonate | 0,003 |
| Acetylacetone | 0,003 |
| | 100,000 |

**diluted with 25% tetraethylene glycol dimethyl ether.

In the above propellant, the concentration of solids is 82%, the concentration of binder is 18% and the concentration of polymer is 8%.

TABLE

EFFECT OF BONDING AGENT CONCENTRATION ON PROPERTIES OF HIGH POLYMER PROPELLANTS

| Concentration of Bonding Agent, % of binder | Polymer, % | Mechanical Properties(1) $\sigma_m$, psi | $\epsilon_m$, % | $\epsilon_r$, % | $E_o$, psi |
|---|---|---|---|---|---|
| 0.000 | 5.6 | 46 | 14 | 27 | 400 |
| 1.500 | 5.6 | 109 | 40 | 41 | 376 |
| 0.900 | 7.2 | 82 | 18 | 22 | 580 |
| 1.350 | 7.2 | 115 | 24 | 26 | 627 |
| 1.575 | 7.2 | 118 | 26 | 28 | 582 |
| 1.800 | 7.2 | 119 | 27 | 30 | 576 |
| 2.025 | 7.2 | 131 | 31 | 33 | 587 |
| 2.250 | 7.2 | 137 | 33 | 35 | 601 |
| 0.375 | 8.0 | 76 | 20 | 30 | 507 |
| 0.750* | 8.0 | 106 | 24 | 30 | 568 |
| 1.125 | 8.0 | 123 | 30 | 33 | 522 |
| 1.500 | 8.0 | 144 | 32 | 34 | 596 |
| 1.875 | 8.0 | 142 | 37 | 39 | 514 |

(1) $\sigma_m$ = Maximum tensile stress (psi)
$\epsilon_m$ = % elongation at maximum stress
$\epsilon_r$ = % elongation at rupture
$E_o$ = Young's modulus (psi).

As will be evident to those skilled in the art, modifications of the present invention can be made in view of the foregoing disclosure without departing from the spirit and scope of the invention.

We claim:

1. A novel solid rocket propellant comprising a polyurethane binder, an oxidizing agent and an effective bond improving amount of a composition having the general formula $$[X_2N(CH_2CH_2NX)_nCH_2CH_2NX_2](HO_3SC_6H_4CH_3)_z$$

wherein n is an integer having a value of 1 to 11, X is —H or —$CH_2CH_2CN$; wherein the amount of —$CH_2CH_2CN$, expressed as y, is in the approximate range of 0.15 (n+4) to 0.45 (n+4), the amount of $HO_3SC_6H_4CH_3$, expressed as z, is in the approximate range of 0.01 (n+4) to 0.25 (n+4), and the ratio y:z is in the range of 1.5:1 to 3:1.

2. The propellant of claim 1 wherein said oxidizing agent is ammonium perchlorate.

3. The propellant of claim 1 wherein the amount of said bond improving composition is in the approximate range of 0.375 to 2.25 weight percent of said binder.

* * * * *

UNITED STATES PATENT AND TRADEMARK OFFICE

CERTIFICATE OF CORRECTION

PATENT NO. : 4,410,376

DATED : October 18, 1983

INVENTOR(S) : Rolf S. Brenner et al

It is certified that error appears in the above-identified patent and that said Letters Patent is hereby corrected as shown below:

Col. 3, line 6, "cyclotetramethyltetranitramine" should read "cyclotetramethylenetetranitramine".

Signed and Sealed this

*Seventh* Day of *February 1984*

[SEAL]

*Attest:*

GERALD J. MOSSINGHOFF

*Attesting Officer*

*Commissioner of Patents and Trademarks*